US010042322B2

(12) United States Patent
Tani

(10) Patent No.: US 10,042,322 B2
(45) Date of Patent: Aug. 7, 2018

(54) IMAGE FORMATION SYSTEM

(71) Applicant: CANON KABUSHIKI KAISHA, Tokyo (JP)

(72) Inventor: Nobuhiro Tani, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/191,991

(22) Filed: Jun. 24, 2016

(65) Prior Publication Data

US 2016/0378060 A1 Dec. 29, 2016

(30) Foreign Application Priority Data

Jun. 25, 2015 (JP) ..... 2015-127427

(51) Int. Cl.
*G03G 15/00* (2006.01)
*G03G 21/20* (2006.01)
*G03G 15/20* (2006.01)

(52) U.S. Cl.
CPC ..... *G03G 21/206* (2013.01); *G03G 15/2017* (2013.01); *G03G 15/5004* (2013.01); *G03G 2215/0129* (2013.01); *G03G 2221/1645* (2013.01)

(58) Field of Classification Search
USPC ..... 399/38, 44, 91–97
See application file for complete search history.

(56) References Cited

U.S. PATENT DOCUMENTS 6,173,132 B1 * 1/2001 Kida ..... G03G 21/0005 399/44
6,594,456 B2 * 7/2003 Kimizuka ..... G03G 21/206 399/44
7,627,259 B2 * 12/2009 Chung ..... G03G 15/2017 399/44

(Continued)

FOREIGN PATENT DOCUMENTS

JP 2001-100619 A 4/2001
JP 2001-242768 A 9/2001

(Continued)

*Primary Examiner* — Hoan Tran
(74) *Attorney, Agent, or Firm* — Fitzpatrick, Cella, Harper & Scinto

(57) ABSTRACT

An image forming apparatus includes an image forming unit configured to form an image on a sheet in accordance with inputted image data, an opening portion configured to allow airflow between an inside and an outside of the image forming apparatus, a detector disposed adjacent to the opening portion and configured to detect a temperature, a fan configured to suction air through the opening and to discharge air from the inside of the image forming unit to cool the image forming unit, a controller configured to control a rotational speed of the fan so as to rotate the fan at a first rotational speed, in an initial state of the image forming apparatus, after actuation of the image forming apparatus, and to rotate the fan at a second rotational speed, less than the first rotational speed, in a stand-by state waiting for the image data to be input after the initial state, and a setting portion configured to set an image forming condition of the (Continued)

image forming unit on the basis of an output of the detector acquired as a result of rotation of the fan at the first rotational speed.

26 Claims, 13 Drawing Sheets

(56) References Cited

U.S. PATENT DOCUMENTS

| | | | | |
|---|---|---|---|---|
| 8,660,456 | B2 * | 2/2014 | Nishino | G03G 21/203 399/100 |
| 8,989,616 | B2 * | 3/2015 | Yasumoto | G03G 15/50 399/94 |
| 9,360,837 | B2 * | 6/2016 | Hirasawa | F24F 11/006 |

FOREIGN PATENT DOCUMENTS

| | | | |
|---|---|---|---|
| JP | 2003-323100 | A | 11/2003 |
| JP | 2005-148105 | A | 6/2005 |

* cited by examiner

IMAGE FORMATION SYSTEM

FIELD OF THE INVENTION AND RELATED ART

The present invention relates an image forming apparatus, in particular, control of its cooling/exhaust fans used for cooling, exhausting, and/or the like function.

An electrophotographic image forming apparatus has been widely used as a copying machine, a printing machine, a facsimileing machine, and also, a multifunction machine capable of functioning as two or more of the preceding machines. In an image forming apparatus such as the above-mentioned one, a toner image is fixed to a sheet of recording medium by the application of heat and pressure to the sheet onto which a toner image has just been transferred, with the use of its fixing device. The proper fixation temperature for the fixation roller of a fixing device needs to be adjusted according to sheet temperature or the like factor. Therefore, some image forming apparatuses are provided with a sensor capable of detecting the ambient temperature and humidity of the apparatus. Generally, the sensor is disposed within the main assembly of the apparatus. The control portion of the image forming apparatus adjusts the fixation temperature of the fixation roller of the fixing device according to the temperature and humidity detected by the sensor.

Further, an image forming apparatus equipped with a cooling/exhausting fan (which hereafter may be referred to as main assembly fan) for cooling the interior of the apparatus main assembly and exhausting the air from within the apparatus main assembly is widely in use. For example, an image forming apparatus which is capable of accurately detecting the ambient temperature and humidity, by having the above-described sensor for detecting the ambient temperature and humidity of the apparatus, in the adjacencies of the main assembly fan is known (Japanese Laid-open Patent Application No. 2003-323100).

In the case of this image forming apparatus, the main assembly fan is turned on or off based on the results of the detection of the ambient temperature and humidity of the apparatus by the sensor. For example, if the temperature detected by the ambient condition (temperature/humidity) sensor becomes no less than a preset level, the main assembly fan is turned on to draw the ambient air into the apparatus main assembly, whereas if it becomes no more than the preset level, the main assembly fan is turned off to stop drawing the ambient air into the apparatus main assembly. This image forming apparatus was designed in consideration of the temperature increase which occurs to the heat generating portions of the apparatus while the electrical power source of the apparatus is off. Thus, the main assembly fan of this apparatus is turned on to draw the ambient air into the apparatus main assembly, immediately after the electric power source of the image forming apparatus is turned off. In the case of this image forming apparatus, the amount by which the ambient air is drawn into the apparatus main assembly by the main assembly fan after the apparatus becomes ready for image formation, and is put on standby for image formation, after the elapse of a certain length time after the electrical power source is turned on is set to be the same as the amount by which the ambient air is drawn into the apparatus main assembly immediately after the electric power source is turned on.

In the case of the above-described image forming apparatus in Japanese Laid-open Patent Application No. 2003-323100, however, the amount by which air is moved by the main assembly fan always remains the same. Therefore, from the standpoint of reducing the apparatus in power consumption and minimizing noises, the amount by which air is moved by the main assembly fan is set to be relatively small. It is therefore possible that even after the elapse of the preset length of time for initializing the apparatus to put the apparatus in the state of being on standby, after the electric power source of the apparatus is turned on, the amount by which the ambient air is drawn into the apparatus main assembly will not be large enough for the interior of the apparatus to be fully cooled, making it possible that the temperature and humidity detected by the ambient condition (temperature/humidity) sensor will be higher than these of the ambient air. If the control device controls the temperature of the fixing device based on the temperature and humidity which are higher than those of the ambient air, it is possible that the image forming apparatus will output defective images. On the other hand, keeping always relatively high the amount by which air is moved by the main assembly fan while the main assembly fan is driven is not desirable from the standpoint of reducing the apparatus in electric power consumption and noises. Further, it possibly overloads the main assembly fan, which in turn reduces the main assembly fan in its life expectancy.

SUMMARY OF THE INVENTION

Thus, the primary object of the present invention is to provide an image formation system capable of detecting the ambient temperature and humidity of the system faster and at a higher level of accuracy than any conventional image formation system.

According to an aspect of the present invention, there is provided an image forming apparatus comprising an image forming apparatus capable of forming an image on a sheet; an opening configured to communicate between an inside and an outside of said apparatus; an ambient condition detector disposed adjacent to said opening and configured to detect a temperature or humidity of an outside of said apparatus; an adjusting portion configured to adjust an image forming condition of an image forming station on the basis of an output of said ambient condition detector; a fan configured to suck through said opening and discharge the air from the inside of said apparatus; and an executing portion for controlling said fan to drive said fan at a first rotational frequency at least during a predetermined period of a period from start of said apparatus to a stand-by state in which an image forming operation is capable and to drive said fan at a second rotational frequency smaller than the first rotational frequency when the stand-by state is reached.

Further features of the present invention will become apparent from the following description of exemplary embodiments with reference to the attached drawings.

BRIEF DESCRIPTION OF THE DRAWINGS

FIG. 10 is a graph which shows the relationship between the temperature detected by the ambient condition (temperature-humidity) sensor of the image forming apparatus, and the actual ambient temperature of the apparatus, part (a) of FIG. 10 representing the main assembly fan of the image forming apparatus in this embodiment, which begins to be rotated at a high speed immediately after the electric power source of the apparatus was turned on, whereas part (b) of FIG. 10 representing the main assembly fan of a comparative (conventional) apparatus, which begins to be rotated at a low speed immediately after the electric power source is turned on.

DESCRIPTION OF THE EMBODIMENTS

Embodiment 1

Next, the first embodiment of the present invention is described in detail with reference to FIGS. 1-10. By the way, in this embodiment, as shown in each of drawings, the frontward and rearward directions of the image forming apparatus 1 will be referred to as the direction F and B, respectively. The leftward and rightward directions will be referred to as the L and R directions, respectively. The upward and downward directions will be referred to as the U and D directions, respectively.

In this embodiment, the image forming apparatus 1 is a full-color printer of the so-called tandem type. However, the application of the present invention is not limited to an image forming apparatus of the tandem type. That is, the present invention is also applicable to an image forming apparatus of any of the other types. Further, the application of the present invention is not limited to a full-color image forming apparatus. That is, the present invention is also applicable to a monochromatic (including black-and-white) image forming apparatus.

Figure 1:
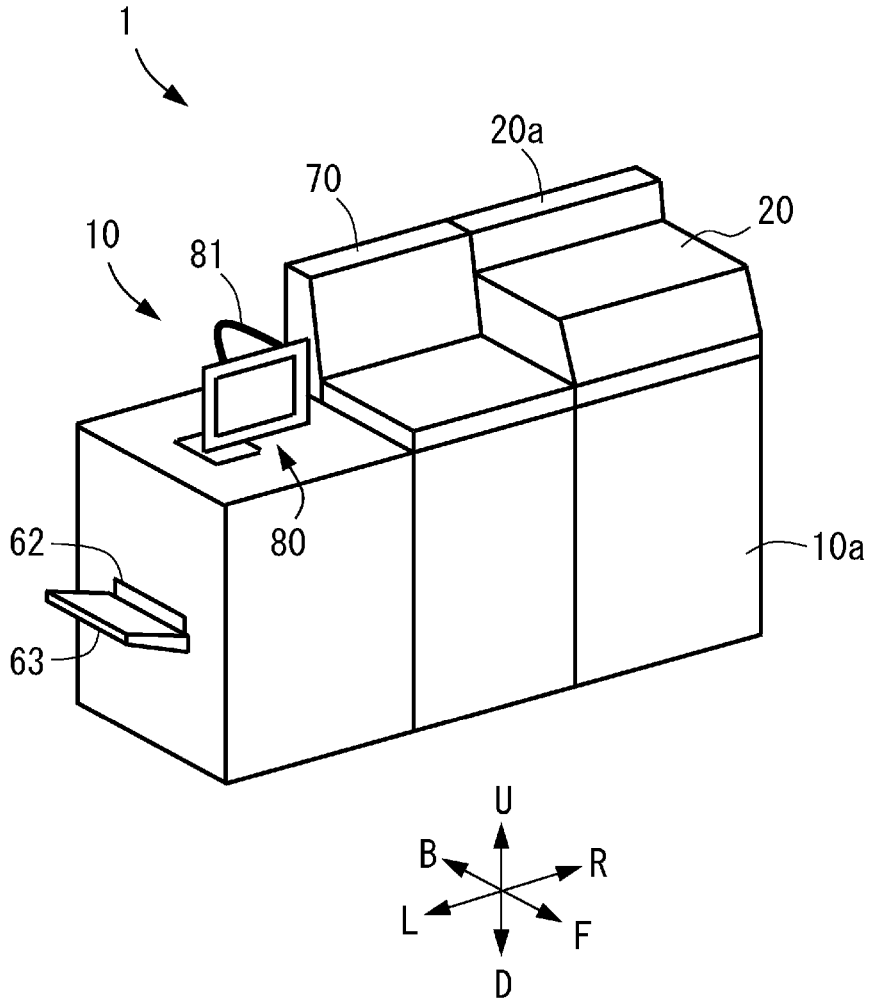
FIG. 1 is a schematic perspective view of the image forming apparatus in the first embodiment of the present invention.
Figure 2:
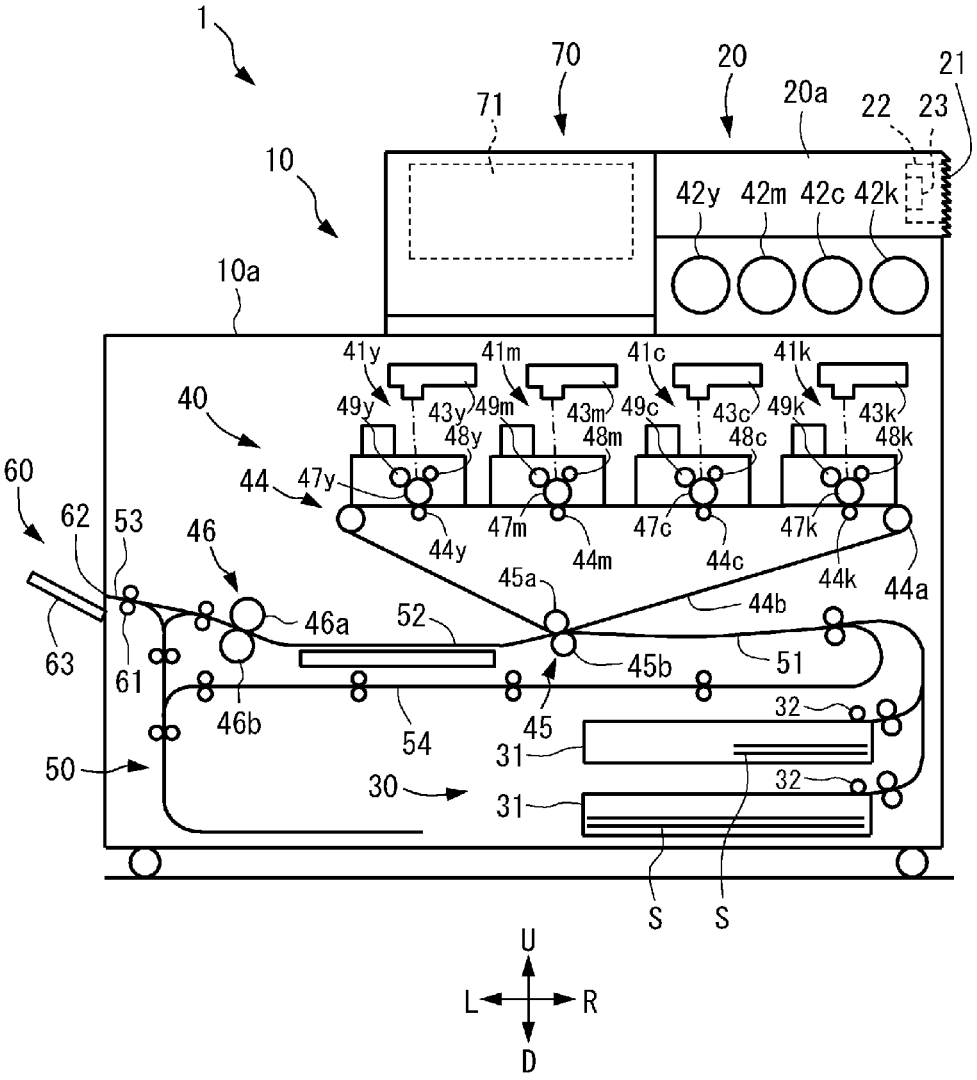
FIG. 2 is a schematic sectional view of the image forming apparatus in the first embodiment.

Referring to FIGS. 1 and 2, the image forming apparatus 1 has a main assembly 10 (which hereafter will be referred to as apparatus main assembly). The apparatus main assembly 10 has a toner supply unit 20, a sheet feeding-conveying portion 30, an image forming portion 40, a sheet conveying portion 50, a sheet discharging portion 60, an electrical unit 70 having a control portion 71, and a control panel 80. By the way, a sheet S, which is a sheet of recording medium, is a sheet on which a toner image is formed. For example, the sheet S may be a sheet of ordinary paper, synthetic resin, cardstock, or a sheet of film for an overhead projector, etc.

The apparatus main assembly 10 has: an external shell 10*a* (main frame) having supporting columns; and portions mounted on the external shell 10*a*. The feeding-conveying portion 30, image forming portion 40, sheet conveying portion 50, and sheet discharging portion 60 are disposed in the external frame 10*a*. The toner supply unit 20, electrical unit 70, and control panel 80 are disposed on the top side of the external shell 10*a*.

The sheet feeding-conveying portion 30 is disposed in the bottom portion of the apparatus main assembly 10. It has: a sheet cassette 31 in which sheets are stored in layers, and a sheet feeder roller 32. It feeds sheet S into the image forming portion 40.

The image forming portion 40 has image formation units 41*y*, 41*m*, 41*c* and 41*k*, toner bottles 42*y*, 42*m*, 42*c* and 42*k*, exposing devices 43*y*, 43*m*, 43*c* and 43*k*, an intermediary transfer unit 44, a secondary transferring portion 45, and a fixing device 46. The image forming portion 40 can form an image based on the information about the image to be formed.

The image formation unit has four image formation units 41*y*, 41*m*, 41*c* and 41*k* for forming four monochromatic toner images, more specifically, yellow (Y), magenta (M), cyan (C) and black (K) toner images, respectively. These image formation units are individually and removably installable in the apparatus main assembly 10. For example, the image formation unit 41*y* has: a photosensitive drum 47*y* on which a toner image is formed; a charge roller 48*y*; a development sleeve 49*y*; an unshown drum cleaning blade; toner; etc. To the image formation unit 41*y*, toner is supplied from the toner bottle 42*y* filled with toner. The other image formation units 41*m*, 41*c* and 41*k* are the same in structure although they are different in the color of toner they contain. Therefore, they are not described in detail.

Within each of the photosensitive drums 47*y*, 47*m*, 47*c* and 47*k*, unshown drum heater control circuit, unshown drum heater which generates heat to control the photosensitive drum in temperature, and unshown thermistor for detecting the temperature of the drum heater, are disposed. The drum heater control circuit is in electrical connection to the drum heater. It turns on or off the electric power to the drum heater in response to the temperature detected by the thermistor. As the electric power is supplied to the drum heater, the drum heater generates heat so that the moisture absorbed by the ionic compounds, additives, and paper dust which adhered to the peripheral surface of the drum, evaporates. Thus, the problem that the absorption of the moisture by the adherents causes an image forming apparatus to output unsatisfactory image (image having appearance of flowing water) is prevented. In a case where an image forming apparatus is left unattended in an environment which is low in temperature and/or high in humidity, with the electric power source turned off, for no less than one night, the interior of the apparatus main assembly 10 is low in temperature. Therefore, it is possible that as soon as the electric power source is turned on, the moisture will condense on the photosensitive drum 47*y*, 47*m*, 47*c* and 47*k*. Therefore, it sometimes occurs that the control portion 71 activates the drum heaters even if the electric power source is off.

The exposing device 43*y* forms an electrostatic latent image on the peripheral surface of the photosensitive drum 47*y* by exposing the peripheral surface of the photosensitive drum 47*y*.

The intermediary transfer unit 44 is disposed in the bottom (D) direction of the image formation units 41*y*, 41*m*, 41*c* and 41*k*. It has multiple rollers, more specifically, a driver roller 44*a*, primary transfer rollers 44*y*, 44*m*, 44*c* and 44*k*, etc., and an intermediary transfer belt 44*b* suspended by some of these rollers. The primary transfer rollers 44*y*, 44*m*, 44*c* and 44*k* are disposed so that they oppose the photosensitive drums 47*y*, 47*m*, 47*c* and 47*k*, respectively, and contact the intermediary transfer belt 44*b*. As positive transfer bias is applied to the intermediary transfer belt 44*b* by the primary transfer rollers 44*y*, 44*m*, 44*c* and 44*k*, the toner images which are on the photosensitive drums 47*y*, 47*m*, 47*c* and 47*k*, one for one, and are negative in polarity, are sequentially transferred in layers onto the intermediary transfer belt 44*b*. Consequently, a full-color image is effected on the intermediary transfer belt 44*b*.

The secondary transferring portion 45 has secondary transfer rollers 45*a* and 45*b*, which are on the inward and outward sides, respectively, of the loop which the intermediary transfer belt 44*b* forms. It is designed so that as positive secondary transfer bias is applied to the outward secondary transfer roller 45*b*, the full-color image effected on the intermediary transfer belt 44*b* is transferred onto the sheet S. By the way, the inward secondary transfer roller 45*a* suspends and keep tensioned the intermediary transfer belt 44*b* from within the belt loop. The outward secondary transfer roller 45*b* is positioned so that it opposes the inward secondary transfer roller 45*b*, sandwiching the intermediary transfer belt 44*b* between itself and inward secondary transfer roller 45*b*.

The fixing device 46 has a fixation roller 46*a* and a pressure roller 46*b*. It is structured so that as the sheet S is conveyed between the fixation roller 46*a* and pressure roller 46*b* while remaining pinched by the two rollers 46*a* and 46*b*, the toner image on the sheet S is subjected to heat and pressure, whereby it is fixed to the sheet S.

Figure 3:
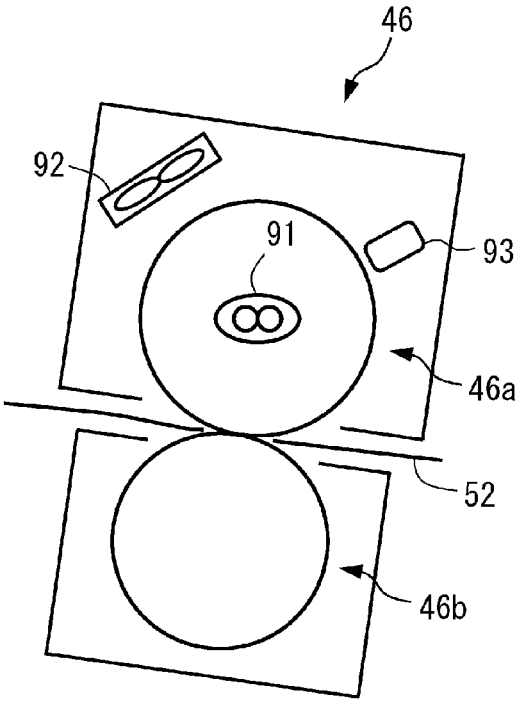
FIG. 3 is a schematic sectional view of the fixing device of the image forming apparatus in the first embodiment.

Referring to FIG. 3, the fixing device 46 has: a fixation heater 91 which heats the fixation roller 46*a* to a preset fixation temperature; a fixation cooling fan 92*a* (which hereafter may be referred to as fixation fan); and a fixation thermistor 93 (temperature sensor) which detects the temperature of the fixation roller 46*a*. That is, the fixation thermistor 93 is disposed within the apparatus main assembly 10, being enabled to detect the internal temperature of the apparatus main assembly 10. The fixation temperature is set according to the basis weight, surface condition, etc., of a sheet of recording medium, temperature detected by the ambient condition sensor 23, which will be described later, and the like factors, with reference to tables prepared in advance. That is, as a user inputs the basis weight, surface properties, etc., of a sheet of medium, through the control panel 80, the control portion 71 determines a target fixation temperature according to the temperature detected by the ambient condition sensor 23, with reference to the tables.

If the temperature detected by the fixation thermistor 93 is lower than the target temperature, the control portion 71 turns on the fixation heater 91, turns off the fixation fan 92, and heats the fixation roller 46*a* until the temperature detected by the fixation thermistor 93 reaches the target value. On the other hand, if the temperature detected by the fixation thermistor 93 is higher than the target level, the control portion 71 turns off the fixation heater 91, turns on the fixation fan 92, and cools the fixation roller 46*a* until the temperature detected by the fixation thermistor 93 reaches the target value. That is, the control portion 71 sets the target temperature for the fixation roller 46*a* with the use of the temperature detected by the ambient condition sensor 23, and controls the actual temperature of the fixation roller 46*a* with the use of the temperature detected by the fixation thermistor developer 93, as described above.

Referring to FIG. 2, the sheet conveying portion 50 has a pre-secondary-transfer sheet conveyance passage 51, a pre-fixation sheet conveyance passage 52, a discharge passage 53, and a re-conveyance sheet passage 54. The image forming apparatus 1 is structured so that as a sheet S is fed into the main assembly 10 from the sheet feeding-conveying portion 30, the sheet conveying portion 50 conveys the sheet S from the image forming portion 40 to the sheet discharging portion 60.

The sheet discharging portion 60 has: a pair of discharge rollers 61 which are disposed on the downstream side of the sheet discharging passage 53; a sheet discharge opening 62 with which the left (L) wall of the apparatus main assembly 10 is provided; and a delivery tray 63 which is disposed on the outward surface of the left (L) wall. The image forming apparatus 1 is structured so that as a sheet S of recording medium is conveyed to the pair of discharge rollers 61 through the discharge passage 53, the pair of discharge rollers 61 conveys the sheet S through their nip, and discharges the sheet S out of the apparatus main assembly 10 through the discharge opening 62. As the sheet S is discharged through the discharge opening 62, it is laid in the delivery tray 63 in a manner to be laid upon the sheets S in the tray 63.

Figure 4:
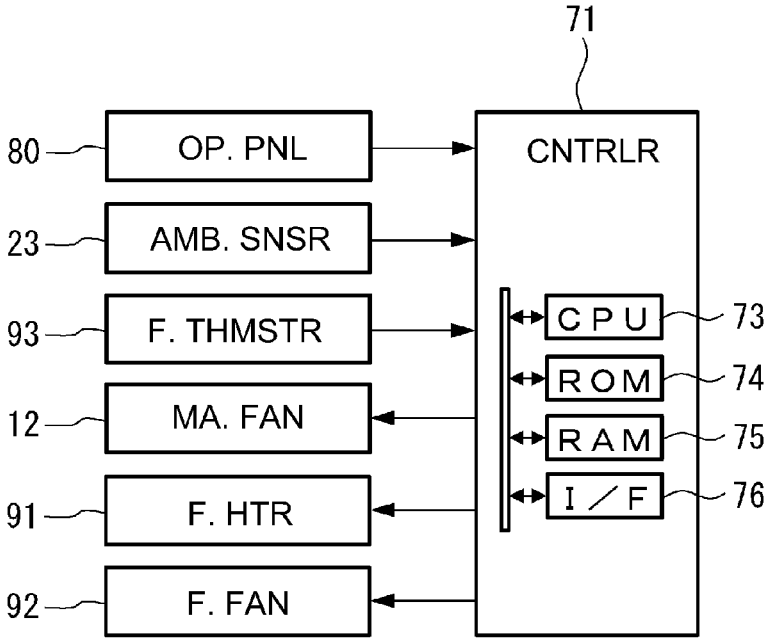
FIG. 4 is a block diagram of the image forming apparatus in the first embodiment, which shows the connection between the control portion of the image forming apparatus and the other portions of the image forming apparatus.

The electrical unit 70 is disposed on the rear (B) side of the apparatus main assembly 10. In terms of the left-right direction, it is disposed on the left (L) side of the toner supply unit 20. It protrudes upward from the top surface of the apparatus main assembly 10. The electrical unit 70 contains the control portion 71, etc. Referring to FIG. 4, the control portion 71 is made up of a computer. For example, it has: a CPU 73, a ROM 74 for storing programs for controlling various portions of the apparatus; an RAM 75 for temporarily storing data; and an input/output circuit 76 (I/F) for inputting signals into the control portion 71 from various portions of the apparatus, or outputting signals to the various portions of the apparatus.

The CPU 73 is a microprocessor which controls the entirety of image forming apparatus 1. It is the main portion of the system controller. It is in connection to the sheet feeding-conveying portion 30, image forming portion 40, sheet conveying portion 50, sheet discharging portion 60, HDD 72, and control panel 80 through the input/output circuit 76. Not only does it exchange signals with each of the above-mentioned portions, but also, controls the operation of each portion. Further, the control portion 71 can control the operation of the main assembly fan 12, and execute commands from an unshown computer which is in connection to the apparatus main assembly 10, and also, can be used by a user through the control panel 80 to operate the image forming apparatus 1 or to input the setting for an image formation job.

The control panel 80 is physically independent from the apparatus main assembly 10. The image forming apparatus 1 is structured so that various portions of the image forming apparatus 1 can be operated through the liquid crystal touch panel of the control panel 80. The control panel 80 is in connection to the electrical unit 70 of the apparatus main assembly 10 through a cable 81, being enabled to be supplied with electric power, and to communicate with the apparatus main assembly 10.

Next, the image forming operation of the image forming apparatus 1 structured as described above is described.

Referring to FIG. 2, as an image forming operation is started, first, the photosensitive drums 47*y*, 47*m*, 47*c* and 47*k* begin to be rotated, and the peripheral surface of each photosensitive drum 47 is charged by the charge rollers 48*y*, 48*m*, 48*c* and 48*k*, respectively. Then, a beam of laser light is emitted toward the photosensitive drum 47*y*, 47*m*, 47*c* and 47*k* by the exposing devices 43*y*, 43*m*, 43*c* and 43*k*, respectively, while being modulated according to the information of the image to be formed. Consequently, an electrostatic latent image is effected on the peripheral surface of each of the photosensitive drums 47*y*, 47*m*, 47*c* and 47*k*. Each of these electrostatic latent images is developed into a visible image, that is, an image formed of toner (which hereafter may be referred to simply as toner image) by the adhesion of toner to the electrostatic latent image. Then, the toner images are transferred onto the intermediary transfer belt 44*b*.

Meanwhile, the sheet feeding-conveying roller 32 is rotated in synchronism with the progression of the toner image forming operation described above, whereby the topmost sheet S in the sheet cassette 31 is moved out of the sheet cassette 31, while being separated from the rest of sheets S in the cassette 31, and is fed into the apparatus main assembly 10. Then, the sheet S is conveyed through the pre-secondary-transfer sheet conveyance passage 51 to the secondary transferring portion 45, with such timing that the toner images on the intermediary transfer belt 44*b* arrive at the secondary transferring portion 45 at the same time as the sheet S. Then, the toner images are transferred onto the sheet S from the intermediary transfer belt 44*b*. Then, the sheet S is conveyed to the fixing device 46, in which heat and pressure are applied to the unfixed toner images on the sheet S. Consequently, the toner images are fixed to the surface of the sheet S. Then, the sheet S is discharged by the pair of discharge rollers 61 through the discharge opening 62, into the delivery tray 63 to be placed in layers in the tray 63.

Figure 5:
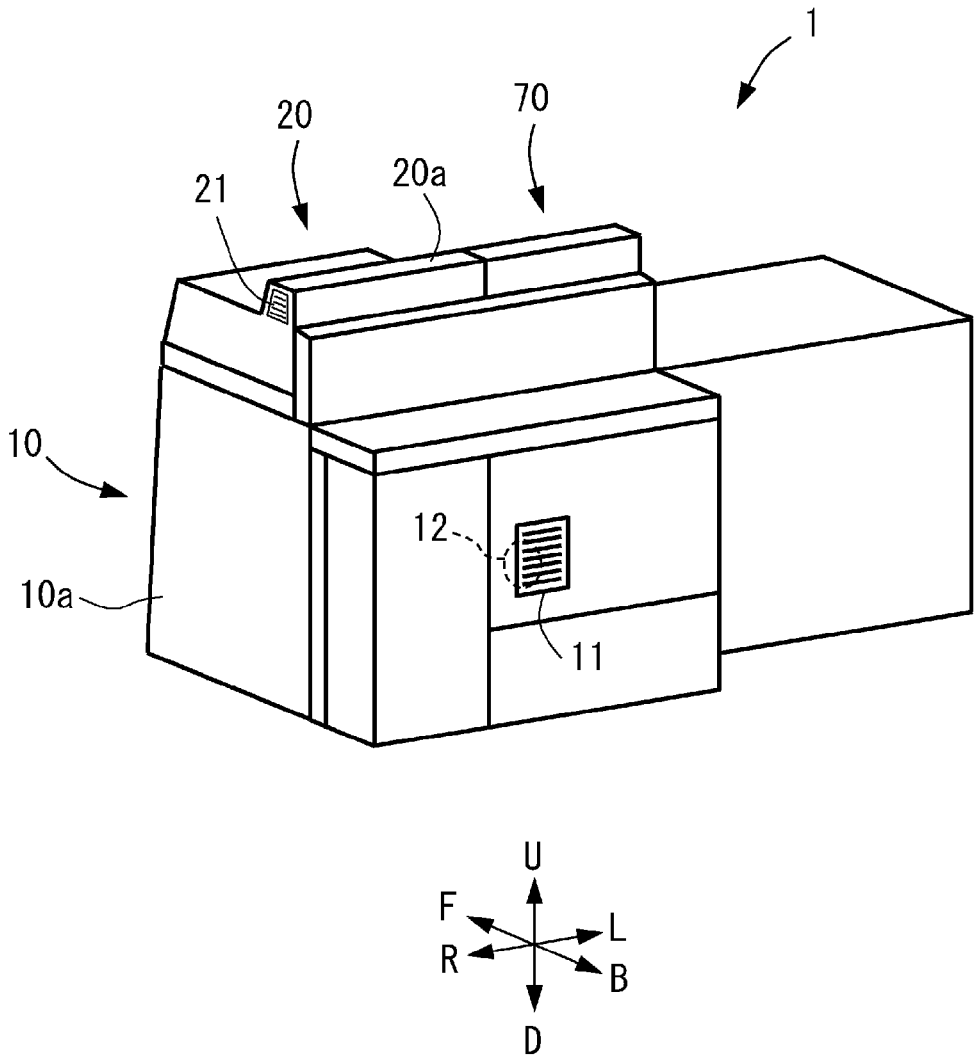
FIG. 5 is a schematic perspective rear view of the image forming apparatus in this embodiment.
Figure 6:
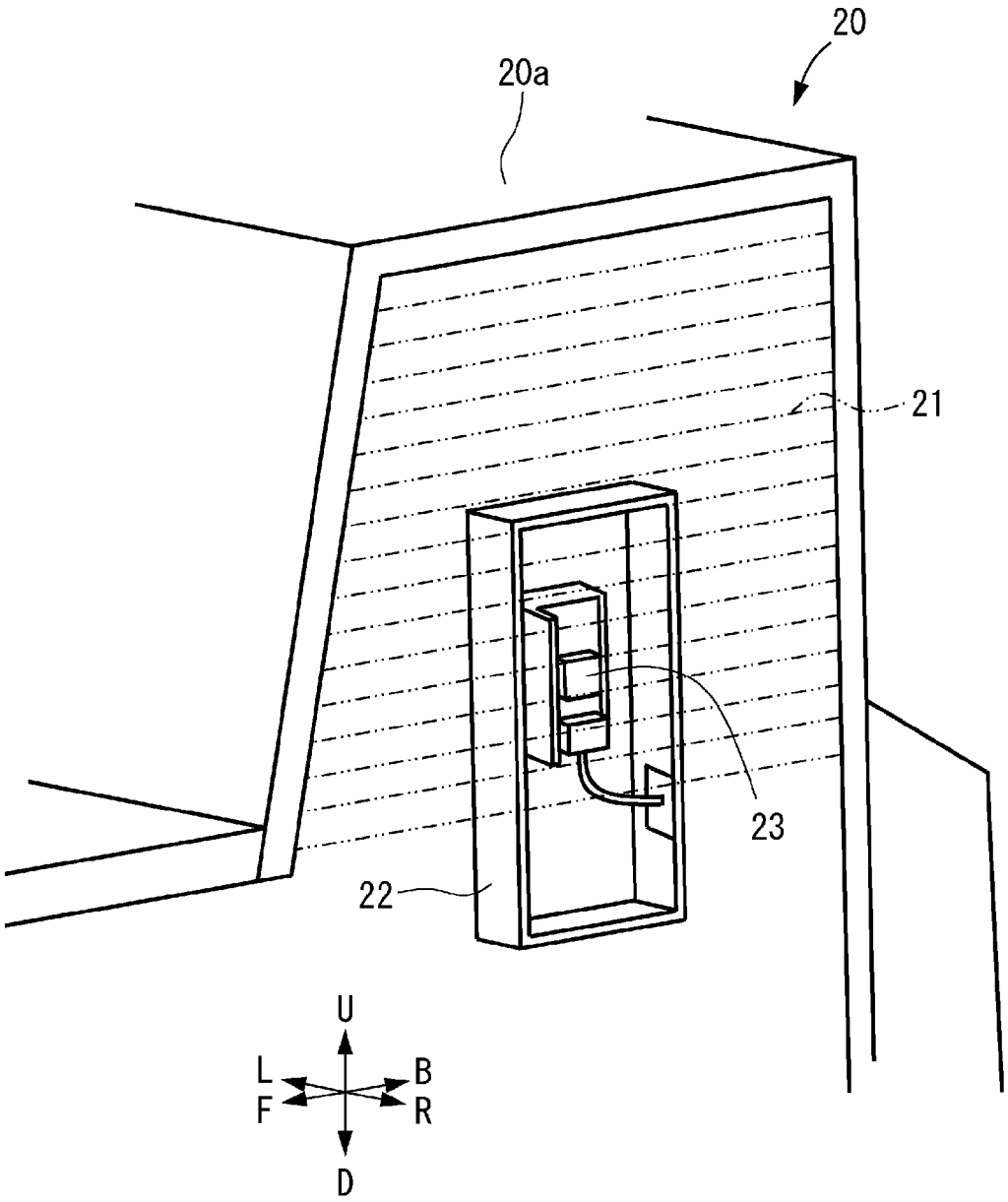
FIG. 6 is a schematic perspective rear view of the ambient condition (temperature-humidity) sensor of the image forming apparatus in this embodiment.

Next, referring to FIGS. 5 and 6, a main assembly exhaust fan 12 for cooling (which hereafter will be referred to as main assembly fan), and an ambient condition sensor 23, are described in detail about their positioning and structure. By the way, in this embodiment the ambient condition sensor 23 is a temperature sensor. However, the ambient condition sensor 23 does not need to be limited to a temperature sensor. For example, a humidity sensor or the like may be used as the ambient condition sensor 23.

Referring to FIG. 5, the rear wall of the apparatus main assembly 10 is provided with a louver 11. On the inward side of the louver 11, the main assembly fan 12 is disposed so that the air in the apparatus main assembly 10 can be exhausted. That is, the main assembly fan 12 is an exhaust fan capable of exhausting the high temperature air in the apparatus main assembly 10 from the apparatus main assembly 10. In other words, it can generate such air movement that causes the air in the apparatus main assembly 10 to be replaced by the ambient air. The main assembly fan 12 can minimize the effects of the heat generated by various heat sources, more specifically, the various driving force source, fixing device 46, electric power circuit, etc., disposed within the apparatus main assembly 10, by exhausting the air heated by these heat sources, out of the apparatus main assembly 10. By the way, the main assembly fan 12 is in connection to the control portion 71, and is controlled by the control portion 71 (FIG. 4).

The toner supply unit 20 is provided with a duct portion 20*a* which slightly protrudes upward from the top rear end of the main portion of the toner supply unit 20, and extends along the top rear end of the main portion of the toner supply unit 20. The duct portion 20*a* is shaped so that it is contiguous with the top portion of the electrical unit 70. The right (R) end of the duct portion 20*a* is provided with a louver 21.

Referring to FIG. 6, the toner supply unit 20 is provided with a boxy frame 22 for supporting the aforementioned ambient condition sensor 23. The boxy frame 22 is inside the duct portion 20*a*, being adjacent to the louver 21. Its opening faces outward (rightward (R)). The ambient condition sensor 23 is disposed in the frame 22. The ambient condition sensor 23, with which the apparatus main assembly 10 is provided, is capable of detecting the condition of the interior of the apparatus main assembly 10. Regarding the positioning of the ambient condition sensor 23, the ambient condition sensor 23 is disposed in the apparatus main assembly 10 so that it is in the top portion of the internal space of the apparatus main assembly 10, which is partitioned from the main portion 10*a* of the apparatus main assembly 10. More specifically, it is in the space partitioned from the sheet conveying portion 30, image forming portion 40, sheet conveying portion 50, and sheet discharging portion 60.

With the ambient condition sensor 23 being positioned as described above, it is possible to minimize the effects of the temperature increase in the main portion 10*a* of the apparatus main assembly 10 upon the ambient condition sensor 23 when the ambient condition sensor 23 is in action, without activating the cooling fan which blows the ambient air upon the ambient condition sensor 23. Further, placing the ambient condition sensor 23 in the top portion of the apparatus main assembly 10 can reduce the possibility that the dust or the like will adhere to the ambient condition sensor 23, and cause the ambient condition sensor 23 to inaccurately detect the ambient condition. Further, the ambient condition sensor 23 is disposed close to the inward side of the louver 21. Therefore, it is capable of detecting the temperature of the body of air which is close to the ambient condition. That is, it is capable of highly accurately detecting the ambient temperature.

At this time, the change in the internal temperature of the apparatus main assembly 10, which occurs when the ambient temperature of the image forming apparatus 1 is low (roughly 18° C.), is described. When the ambient temperature of the image forming apparatus 1 is low, in order to prevent the image forming apparatus 1 from outputting unsatisfactory images, even if the main electric power source is off, the drum heaters are turned on to heat the photosensitive drums 47*y*, 47*m*, 47*c* and 47*d*. By the way, immediately after a substantial number of sheets of recording medium have just been conveyed through the image forming apparatus 1, the interior of the apparatus main assembly 10 has been affected by the increase in the internal temperature of each unit even if the main electrical power source is off. That is, even if the main electric power source is off, the internal temperature of the apparatus main assembly 10 increases. The increase in this internal temperature continues to be affected by the drum heaters, even after the elapse of a substantial length of time after the main electrical power source is turned off. That is, the internal temperature of the apparatus main assembly 10 continues to increase even after the main electric power source is turned off.

If the main electrical power source is turned on while the internal temperature of the apparatus main assembly 10 is remaining high, the ambient condition sensor 23 is affected by the internal temperature of the apparatus main assembly 10. Thus, the temperature detected by the sensor 23 is higher than the actual ambient temperature. It takes a substantial length of time to eliminate the effects of the internal temperature of the apparatus main assembly 10. Therefore, even if the timing with which temperature is detected by the ambient condition sensor 23 is immediately after an image formation start command is inputted, it is possible that the temperature detected by the ambient condition sensor 23, which is higher than the actual ambient temperature, will be used to control the image forming apparatus 1.

Figure 7:
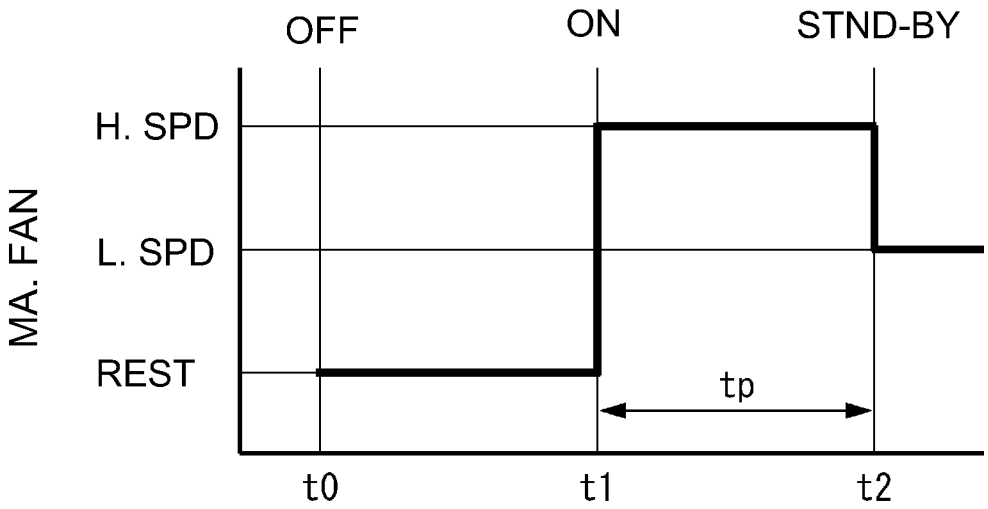
FIG. 7 is a timing chart which shows the rotational speed of the main assembly fan of the image forming apparatus in this embodiment.

Referring to FIG. 7, in this embodiment, therefore, immediately after the main electric power source of the image forming apparatus 1 is turned on, the main assembly fan 12 is turned on, and kept turned on at a higher rotational speed (increased in rotational speed) than the normal speed, or the speed when the image forming apparatus 1 is kept on standby, for the duration of at least a preset period tp. That is, the control portion 71 drives the main assembly fan 12 for the duration of at least the preset period tp, that is, during the period between when the apparatus main assembly 10 is turned on, and the image forming apparatus 1 becomes ready for image formation. During this preset period tp, the control portion 71 keeps the amount by which the main assembly fan 12 moves air, greater than when the image forming apparatus 1 is kept on standby, that is, when the image forming portion 40 is kept ready for image formation, and waiting for an image formation start command signal.

In this embodiment, the preset period tp is between when the apparatus main assembly 10 is turned on (main electric power source is turned on), and when the image forming apparatus 1 becomes ready for image formation. The rotational speed at which the main assembly fan 12 is to be driven immediately after the main electric power source is turned on is set to the full speed, or the normal speed, whereas the rotational speed at which the main assembly fan 12 is to be driven while the image forming apparatus 1 is kept on standby is set to half the normal speed. Here, that the image forming apparatus 1 is kept on standby means that the image forming portion 40 is kept ready to immediately respond to the inputting of an image formation start command. Further, the full rotational speed means the maximum speed at which the main assembly fan 12 can be rotated, whereas half the rotational speed means half the full rotational speed. The reason why the speed at which the main assembly fan 12 is rotated while the image forming apparatus 1 is kept on standby is set to half the normal rotational speed of the main assembly fan 12 is that even if the rotational speed of the main assembly fan 12 is reduced from the normal one to half the normal one, the apparatus main assembly 10 can be satisfactorily cooled. That is, it is from the standpoint of reducing the image forming apparatus 1 in energy consumption, and also, reducing the image forming apparatus 1 in noise.

Further, it is after the elapse of the preset period tp that the control portion 71 begins to detect temperature with the use of the ambient condition sensor 23. In particular, in this embodiment, it is after an image formation start signal is inputted after the elapse of the preset period tp that the control portion 71 begins to detect the ambient temperature with the use of the ambient condition sensor 23.

Figure 8:
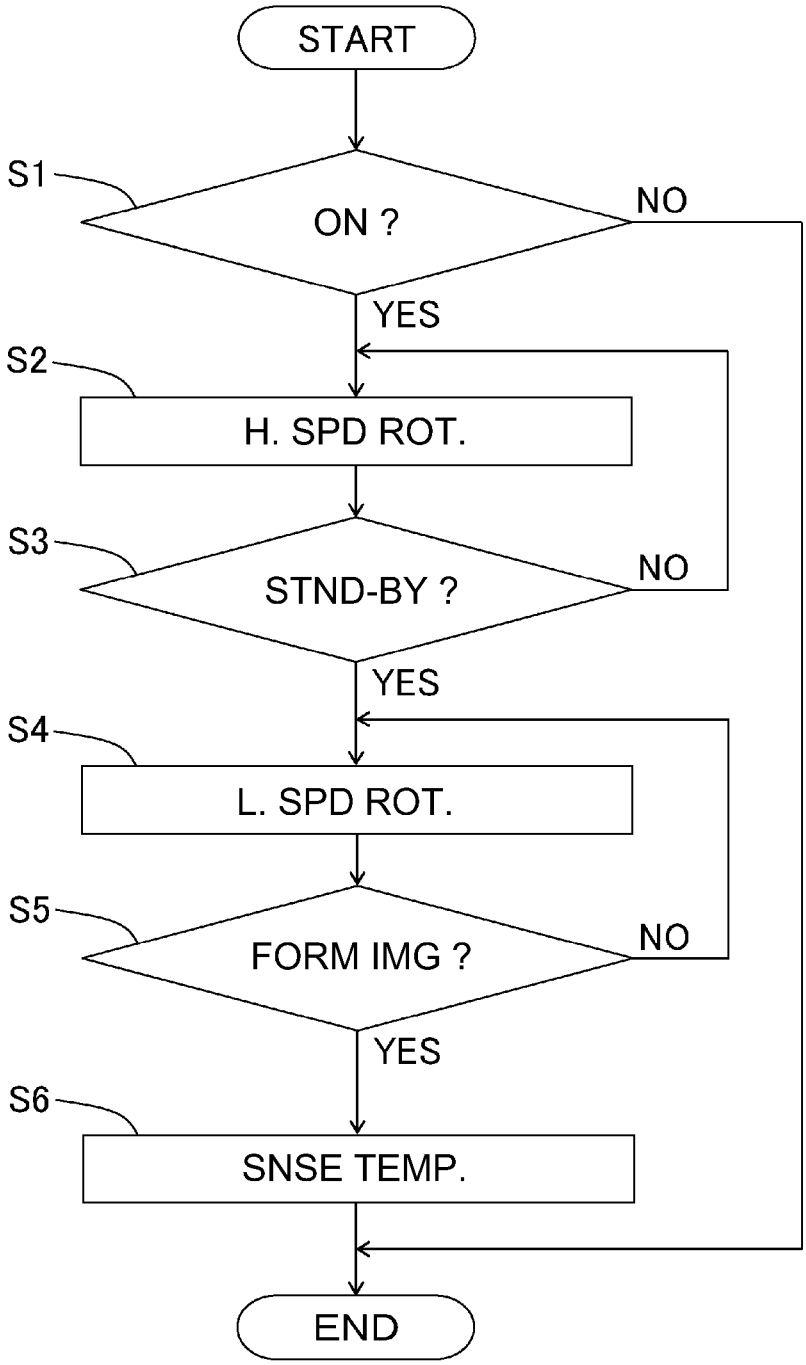
FIG. 8 is a flowchart of the operation of the image forming apparatus in this embodiment.

Next, referring to FIG. 7, which is a timing chart, and FIG. 8, which is a flowchart, the steps through which the main assembly fan 12 of the image forming apparatus 1 is activated are described.

When the main electric power source is off, the control portion 71 keeps the main assembly fan 12 turned off (t0 in FIG. 7). The control portion 71 checks whether or not the main electric power source is on (step S1 in FIG. 8). If it determines that the main electric power source is not on, it ends the procedure. If it determines that the main electric power source is on, it begins to rotate the main assembly fan 12 at the high speed (step S2 in FIG. 8, and t1 in FIG. 7). Here, the high speed is the maximum speed, for example, at which the main assembly fan 12 can be rotated.

Next, the control portion 71 checks whether or not the image forming apparatus 1 has become ready (is on standby) for image formation. If it determines that the image forming apparatus 1 is not on standby (not ready) for image formation, it continues to rotate the main assembly fan 12 at the high speed (step S2 in FIG. 8). If it determines that the image forming apparatus 1 is on standby for image formation, it rotates the main assembly fan 12 at the low speed (step S4 in FIG. 8, and t2 in FIG. 7). Here, the low speed is half, for example, the maximum speed at which the main assembly fan 12 can be rotated.

Next, the control portion 71 checks whether or not an image formation start command has been inputted (step S5 in FIG. 8). If it determines that an image formation start command has not been inputted, it continues to rotate the main assembly fan 12 at the low speed (step S4 in FIG. 8). If it determines that an image formation start command has been inputted, it detects temperature with the use of the ambient condition sensor 23 (step S6 in FIG. 8).

As described above, the image forming apparatus 1 in this embodiment can more quickly exhaust the internal air from itself before the image forming apparatus 1 becomes ready for image formation, than an image forming apparatus, the main assembly fan 12 of which cannot be changed in the amount of air flow. Therefore, it is capable of more quickly making the internal temperature and humidity of the apparatus main assembly 10 closer to the ambient temperature and humidity. In addition, it is only during the preset period tp that the main assembly fan 12 is kept higher in the amount by which the main assembly fan 12 moves air. Therefore, the image forming apparatus 1 in this embodiment is substantially smaller in electric power consumption than any conventional image forming apparatus. That is, this embodiment makes it possible for an image forming apparatus 1 to more quickly draw the ambient air into the apparatus main assembly 10 than any conventional image forming apparatus, while reducing an image forming apparatus 1 in electric power consumption, and the amount of noise. In other words, this embodiment can improve an image forming apparatus 1 in the length of time required for temperature control, while properly controlling the image forming apparatus 1 in temperature. Therefore, this embodiment can improve an image forming apparatus 1 in productivity while improving the image forming apparatus 1 in print quality.

Moreover, according to this embodiment, it is after an image formation start signal is inputted after the elapse of the preset period tp after the image forming apparatus 1 is turned on, that the control portion 71 of the image forming apparatus 1 begins to detect the ambient temperature of the image forming apparatus 1 with the use of the ambient condition sensor 23. That is, the control portion 71 begins to detect the temperature of the ambient air with the use of the ambient condition sensor 23 after the internal temperature of the apparatus main assembly 10 reduces close to the same level as the ambient air. Therefore, the temperature detected by the ambient condition sensor 23 of the image forming apparatus 1 in this embodiment is virtually the same as the actual ambient temperature. That is, this embodiment (present invention) can improve the accuracy with which the ambient temperature is detected by the ambient condition sensor 23 of an image forming apparatus.

In the embodiment described above, the control portion 71 keeps the rotational speed of the main assembly fan 12 at the full speed for the preset period tp, whereas while the image forming apparatus 1 is kept on standby, the control portion 71 rotates the main assembly fan 12 at half the full speed. This embodiment, however, is not intended to limit the present invention in scope in terms of the rotational speed of the main assembly fan 12. For example, an image forming apparatus may be designed so that the high rotational speed for the main assembly fan 12 is roughly 80% of the full rotational speed of the main assembly fan 12, whereas the low rotational speed for the main assembly fan 12 is roughly 60% of the full rotational speed.

Moreover, in this embodiment, the number of the main assembly fan 12 was only one, and the single main assembly fan 12 was adjusted in rotational speed to adjust the amount by which the main assembly fan 12 moves air per unit length of time. This embodiment, however, is not intended to limit the present invention in the number of main assembly fans 12. For example, the image forming apparatus 1 may be provided with two or more main assembly fans 12, and the overall amount by which the internal air of the apparatus main assembly 10 is exhausted per unit length of time may be adjusted by the adjustment of the number of the main assembly fans 12 to be activated.

Furthermore, in this embodiment, the fixation temperature for the fixing device 46 is set based on the temperature detected by the ambient condition sensor 23. However, this embodiment is not intended to limit the present invention in scope in terms of the choice of the portion(s) of an image forming apparatus, which is controlled by the control portion 71 based on the results of temperature detection by the ambient condition sensor 23. For example, an image forming apparatus may be structured so that its secondary transferring portion 45 or the like is controlled based on the temperature detected by the ambient condition sensor 23.

Embodiment

At this time, a case in which the interior of the main assembly 10 of the image forming apparatus 1 in the above-described embodiment is cooled is described.

Figure 9:
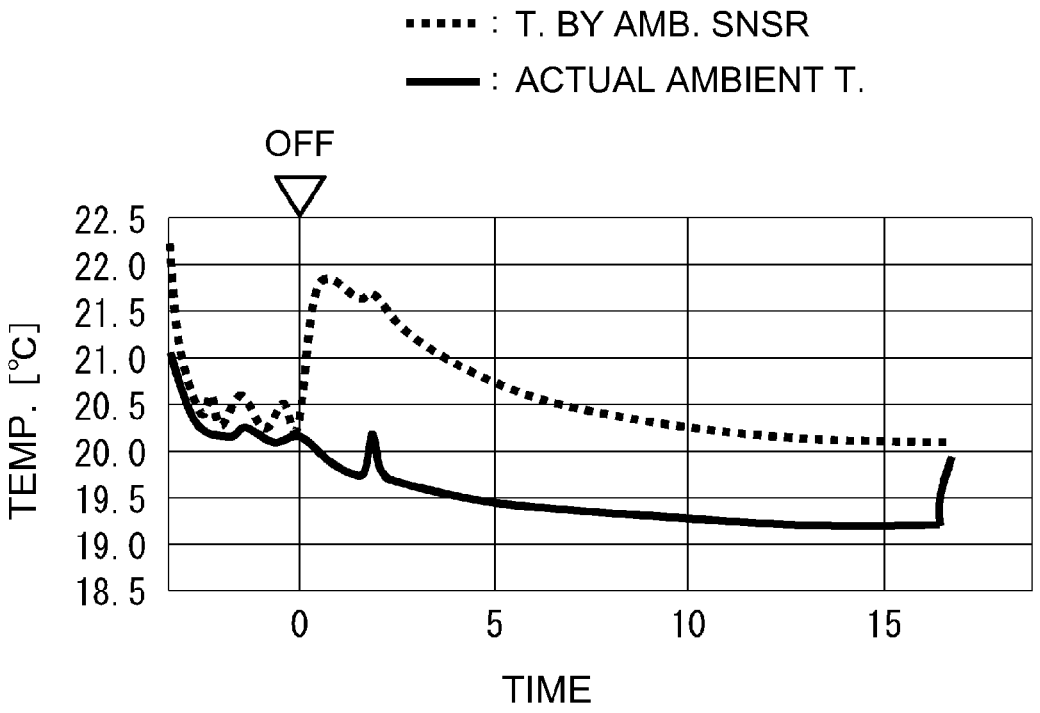
FIG. 9 is a graph which shows the relationship between the temperature detected by the ambient condition (temperature-humidity) sensor of the image forming apparatus, and the actual ambient temperature of the apparatus.

Referring to FIG. 9, immediately after the main electric power source was turned off, the temperature detected by the ambient condition sensor 23 increased. Even after the image forming apparatus 1 is left unattended roughly 15 hours after the main electric power source was turned off, the temperature detected by the ambient condition sensor 23 was roughly 1° C. higher than the ambient temperature. That is, it was confirmed that the internal temperature of the apparatus main assembly 10 was increased by the drum heaters, and therefore, the temperature detected by the ambient condition sensor 23 was higher due to this increase in the internal temperature of the apparatus main assembly 10.

Figure 10:
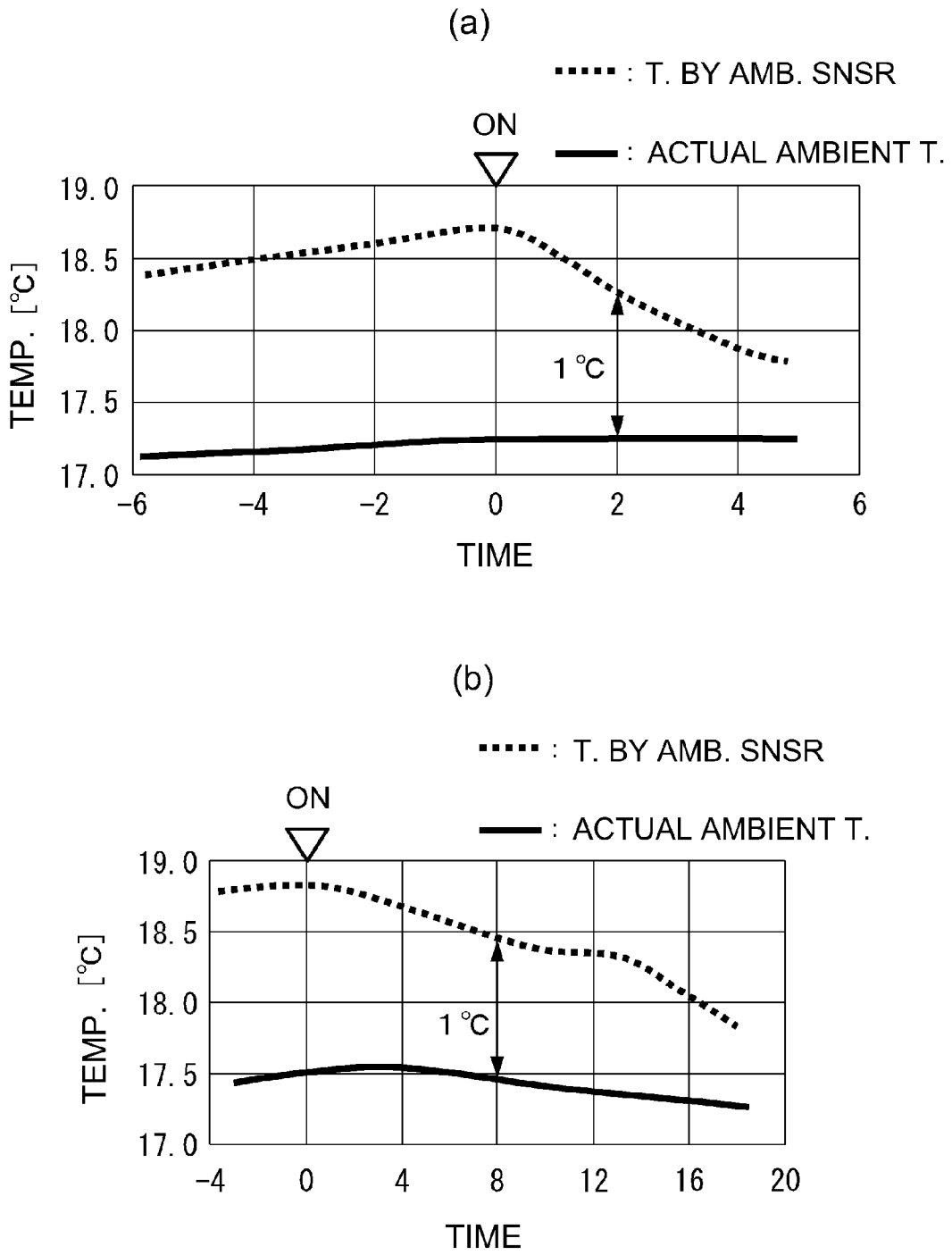

Further, referring to part (a) of FIG. 10, after the main electric power source was turned off, the internal temperature of the apparatus main assembly 10 was increased by the drum heaters. Then, as the difference between the temperature detected by the ambient condition sensor 23 and the ambient temperature became roughly 1.5° C., the control portion 71 began to rotate the main assembly fan 12 at the high rotational speed by turning on the main electric power source. In this case, it took roughly 2 minutes for the difference between the temperature detected by the ambient condition sensor 23 and the ambient temperature to become no more than roughly 1° C.

(Comparative Image Forming Apparatus)

In comparison, referring to part (b) of FIG. 10, also in the case of a comparative image forming apparatus, after the electric power source was turned off, the internal temperature of the apparatus main assembly 10 was increased by the drum heaters. Then, as the difference between the temperature detected by the ambient condition sensor 23 and the ambient temperature became roughly 1.5° C., the main assembly fan 12 was rotated at the low speed by turning on the main electric power source. In this case, it took roughly 8 minutes for the difference between the temperature detected by the ambient condition sensor 23 and the ambient temperature to become no more than roughly 1° C.

Thus, it was possible to confirm that by making the speed at which the main assembly fan 12 begins to be rotated immediately after the main electric power source is turned on, greater than half the full speed, at which the main assembly fan 12 is rotated while the image forming apparatus 1 is kept on standby, the ambient temperature can be detected more accurately and faster than in the case of a conventionally structured image forming apparatus. Further, if an image forming apparatus is structured so that, after the warm (hot) air in the apparatus main assembly 10 is exhausted, the apparatus becomes ready for image formation, it is possible to reduce by roughly 6 minutes, the length of time required for reducing the difference between the temperature detected by the ambient condition sensor 23 and the actual ambient temperature, compared to the comparative image forming apparatus. In other words, this embodiment can improve an image forming apparatus in productivity. With an image forming apparatus being structured as described above, by the time an image formation start command is inputted, the body of air in the apparatus main assembly 10, which might have significantly increased in temperature, will have been exhausted. Therefore, the image forming apparatus in this embodiment can detect the ambient condition of the apparatus, and reflect the detected ambient condition upon various controls of the apparatus, faster and more precisely than any conventional image forming apparatus.

Embodiment 2

Figure 11:
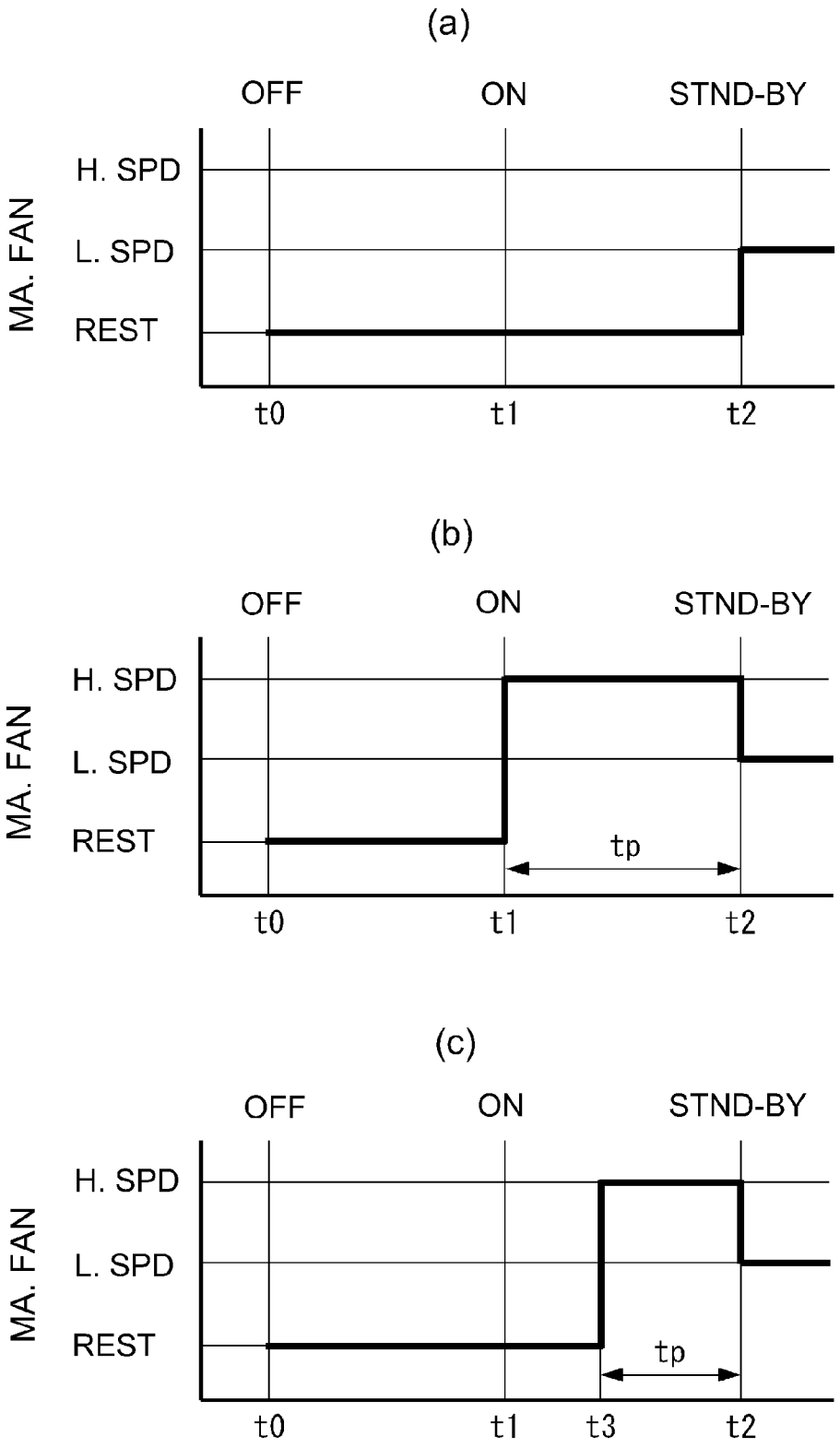
FIG. 11 is a timing chart which shows the rotational speed of the main assembly fan of the image forming apparatus in the second embodiment of the present invention, part (a) of FIG. 11 representing a case in which the internal temperature of the apparatus main assembly is lower than a preset level, part (b) of FIG. 11 representing a case in which the internal temperature of the apparatus main assembly is substantially higher than the preset level, and part (c) of FIG. 11 representing a case in which the internal temperature of the apparatus main assembly is slightly higher than the preset level.
Figure 12:
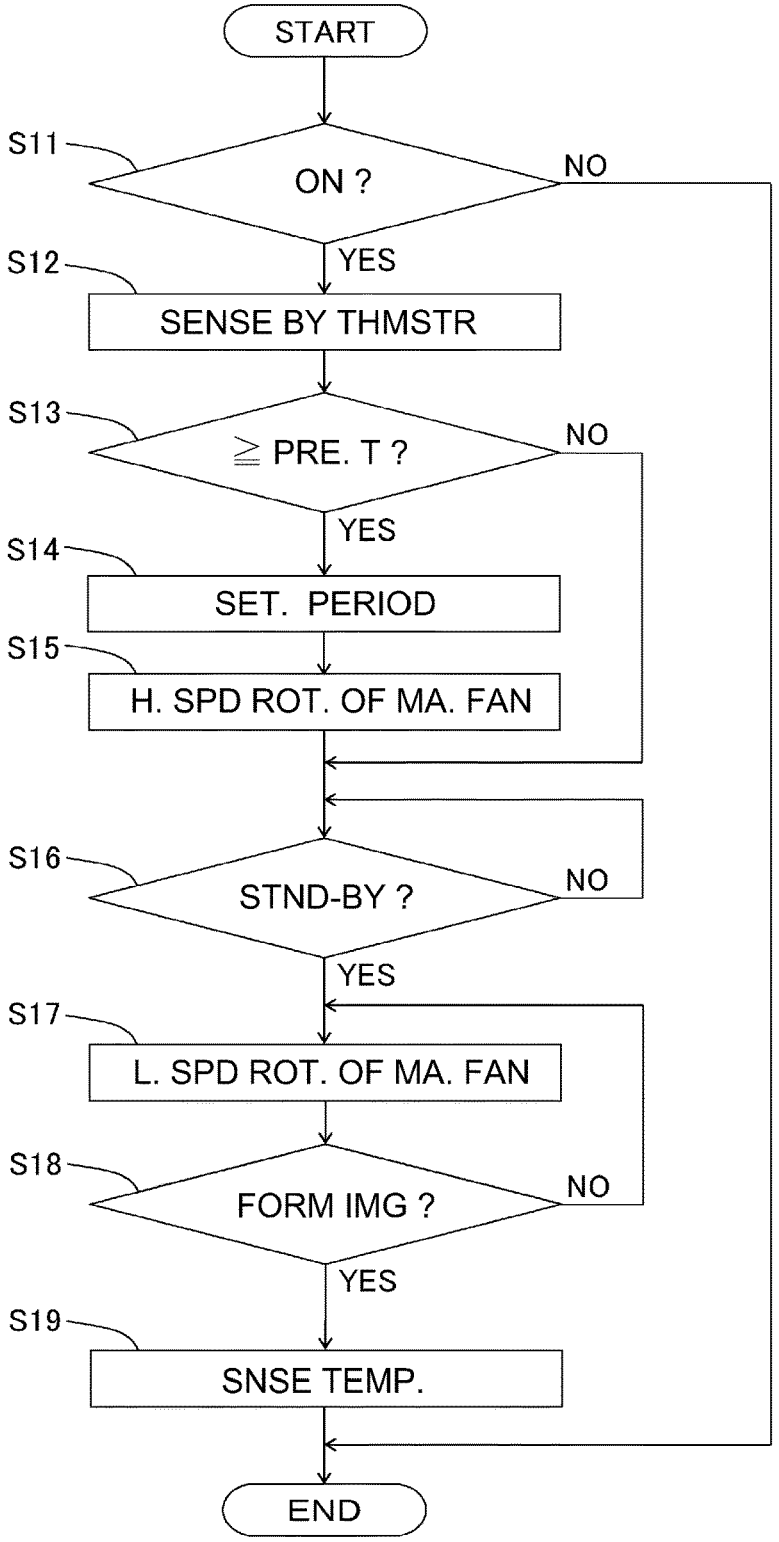
FIG. 12 is a flowchart of the operation of the image forming apparatus in the second embodiment.

Next, referring to FIGS. 11 and 12, the second embodiment of the present invention is described in detail. By the way, this embodiment is different from the first embodiment only in that the preset period tp during which the main assembly fan 12 is to be rotated at the high speed is varied according to the temperature detected by the fixation thermistor 93. Otherwise, the image forming apparatus in this embodiment is the same in structure as the one in the first embodiment. Therefore, the structural components of the image forming apparatus in this embodiment, which are similar in structure to the counterparts of the image forming apparatus in the first embodiment, are given the same referential codes as those given to the counterparts, and are not described in detail.

In this embodiment, the control portion 71 sets the period tp, based on the temperature detected by the fixation thermistor 93. Thus, even if the fixation heater 91 is turned on after the main electric power source is turned on, it is possible to prevent the problem that the heat from the fixation heater 91 affects the setting of the period tp. Next, referring to FIG. 11, this embodiment is described in detail.

Part (a) of FIG. 11 represents a case in which the internal temperature of the apparatus main assembly 10 is lower than a preset level, because when the main electric power source is off, the drum heaters are not turned on, is described. In this case, the control portion 71 determines that the internal temperature of the apparatus main assembly 10 is low enough to make it unnecessary to exhaust the air in the apparatus main assembly 10 (ventilate the apparatus main assembly 10). Then, it sets the period tp to zero. That is, it does not turn on the main assembly fan 12 at least until the image forming apparatus 1 becomes ready for image formation.

Part (b) of FIG. 11 represents a case in which the internal temperature of the apparatus main assembly 10 is substantially higher than a preset value, because the drum heaters were operated for a substantial length of time while the main electric power source was off, for example. In this case, the control portion 71 determines that the internal temperature of the apparatus main assembly 10 is high enough to make it necessary to fully ventilate the apparatus main assembly 10. Then, it sets the period tp to (t2–t1), and rotates the main assembly fan 12 at the high speed during the period tp.

Part (c) of FIG. 11 represents a case in which the drum heaters were operated for a short length of time while the main electric power source was off, and therefore, the internal temperature of the apparatus main assembly 10 is only slightly higher than the preset level. In this case, the control portion 71 determines that the internal temperature of the apparatus main assembly 10 is slightly higher than the normal level, and therefore, the apparatus main assembly 10 needs to be ventilated less than in a case where the internal temperature is higher than the preset level (which is substantially higher than normal level). Then, it estimates a point t3 in time at which the image forming apparatus 1 becomes ready for image formation. Then, it sets the period tp to (t2–t3), and rotates the main assembly fan 12 at the high speed during the period tp. In this embodiment, by the way, after the main electric power source is turned on, the main assembly fan 12 is not turned on until the point t3 in time. Then, it is turned on at the time t3, and is rotated at the high speed. This embodiment, however, is not intended to limit the present invention in scope regarding the control of the main assembly fan 12. For example, the main assembly fan 12 may be controlled so that after the main electric power source is turned on, it is rotated at the high speed until an optional point in time which is earlier than the point t2, is stopped at the optional point, and then, is rotated at the low speed once the image forming apparatus 1 becomes ready for image formation.

Next, referring to the timing chart in FIG. 11, and the flowchart in FIG. 12, steps to be taken by the image forming apparatus 1 to operate its main assembly fan 12 are described.

When the main electric power source is off, the control portion 71 keeps the main assembly fan 12 turned off (t0 in FIG. 11). The control portion 71 checks whether or not the main electric power source is on (step S11 in FIG. 12). If it determines that the main electric power source is not on, it ends the operation. If it determines that the main electric power source is on, it detects the temperature of the fixation roller 46*a* with the use of the fixation thermistor 93 (step S12 in FIG. 12, and t1 in FIG. 11).

The control portion 71 checks whether or not the temperature detected by the fixation thermistor 93 is no less than a preset level (step S13 in FIG. 12). If it determines that the temperature detected by the fixation thermistor 93 is no less than the preset level, it sets the period tp, based on the detected temperature (step S14 in FIG. 12). Then, it rotates the main assembly fan 12 at the high speed for the duration of the period tp (step S15 in FIG. 12).

If the control portion 71 determines that the temperature detected immediately after it starts the main assembly fan 12, or the temperature detected in step S13, is no more than the preset level, it checks whether or not the image forming apparatus 1 is on standby for image formation (step S16 in FIG. 12). If it determines that the image forming apparatus 1 is not in the state of being on standby, it continues to rotate the main assembly fan 12 at the high speed, and checks again whether or not the image forming apparatus 1 is on standby for image formation (step S16 in FIG. 12). If it determines that the image forming apparatus 1 has become ready for image formation, it begins to rotate the main assembly fan 12 at the low speed (step S17 in FIG. 12, and t2 in FIG. 11).

Next, the control portion 71 checks whether or not an image formation start command has been inputted (step S18 in FIG. 12). If it determines that an image formation start command has not been inputted, it continues to rotate the main assembly fan 12 at the low speed (step S7 in FIG. 12). If it determines that an image formation start command has been inputted, it detects the ambient temperature with the use of the ambient condition sensor 23 (step S19 in FIG. 12).

As described above, the image forming apparatus 1 in this embodiment also can more quickly ventilate itself before it becomes ready for image formation than an image forming apparatus, which does not change in the amount by which air is moved by its main assembly fan, regardless of whether or not it has become ready for image formation. Therefore, the image forming apparatus 1 in this embodiment can quickly make the internal temperature and humidity of its main assembly 10 close to those of the ambient air. In addition, it is only during the preset period tp that it increases the amount by which its main assembly fan 12 moves air. Therefore, it is significantly smaller in electric power consumption. In other words, the image forming apparatus 1 in this embodiment also can quickly take in the ambient air into its main assembly 10 while minimizing electric power consumption and noises.

Further, according to this embodiment, whether or not the main assembly fan 12 needs to be turned on after the main electric power source is turned on is determined based on whether or not the drum heaters were on, which is detected by the fixation thermistor 93. That is, the control portion 71 sets a period tp, based on the temperature detected by the fixation thermistor 93. Therefore, the length of time the main assembly fan 12 is to be rotated at the high speed is minimized. That is, this embodiment can more effectively reduce an image forming apparatus in electric power consumption and noises.

Embodiment 3

Figure 13:
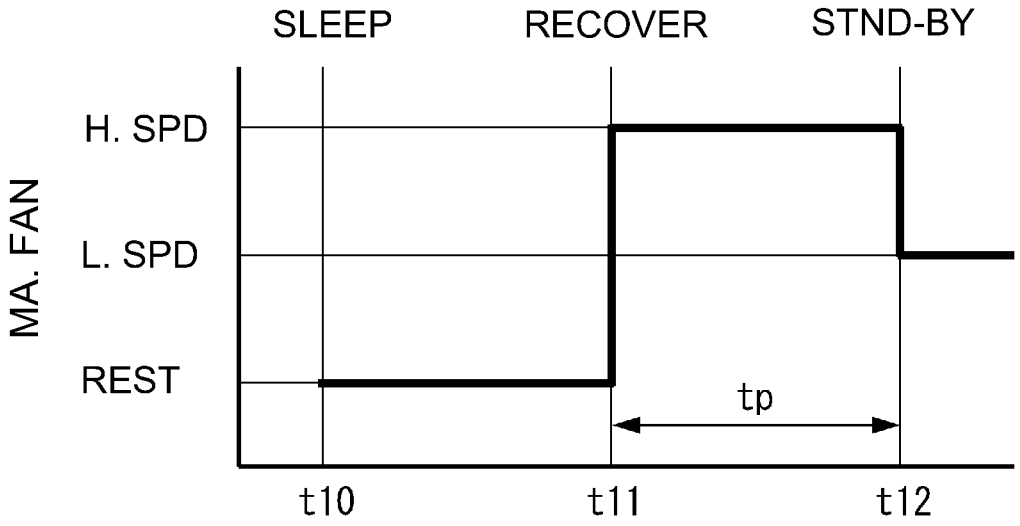
FIG. 13 is a timing chart of the rotational speed of the main assembly fan of the image forming apparatus in the third embodiment of the present invention.
Figure 14:
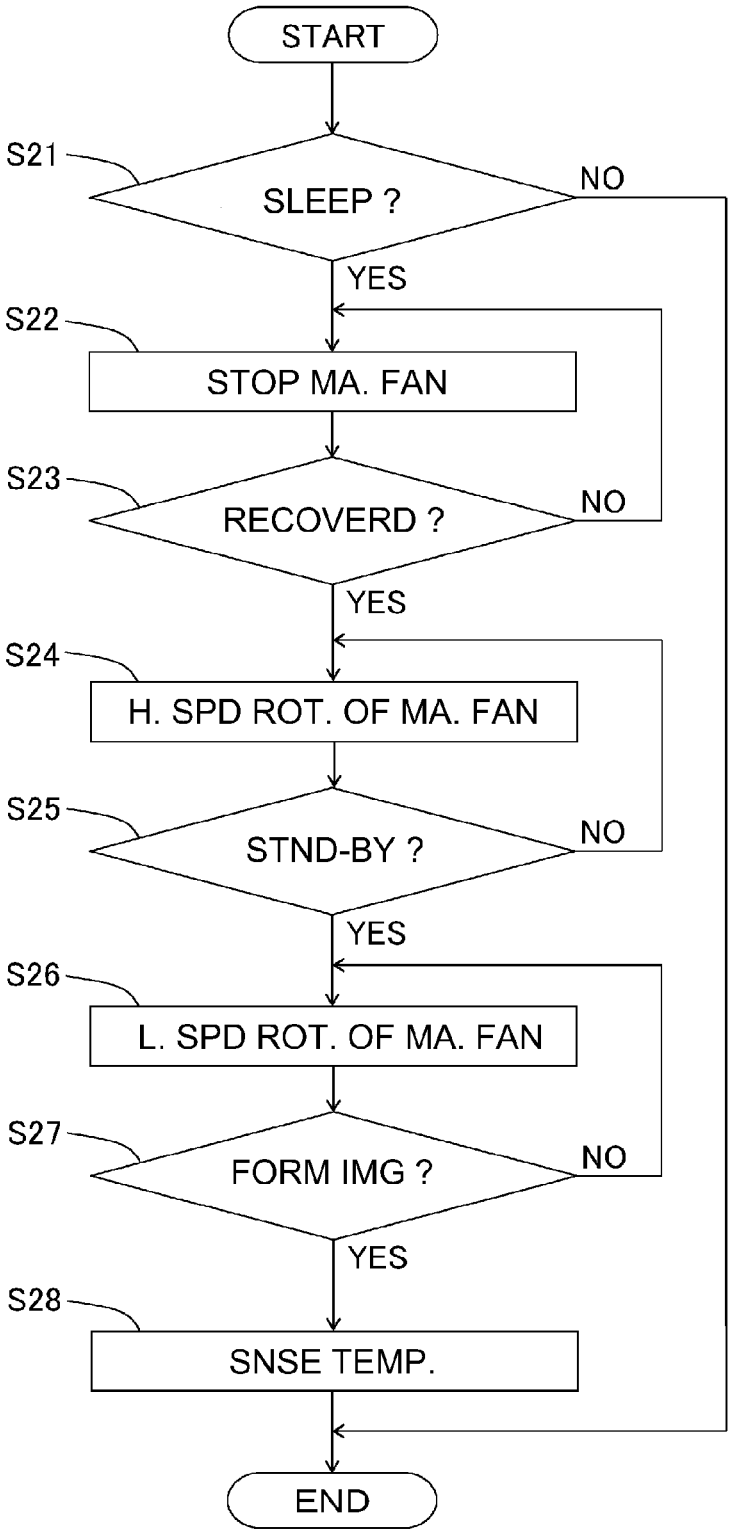
FIG. 14 is a flowchart of the operation of the image forming apparatus in the third embodiment.

Next, referring to FIGS. 13 and 14, the third embodiment of the present invention is described in detail. By the way, this embodiment is different from the first embodiment only in that it is while the image forming apparatus 1 is kept in the state of being asleep that the image forming apparatus 1 is started up. Otherwise, this embodiment is similar to the first embodiment. Thus, the structural components of the image forming apparatus 1 in this embodiment, which are similar to the counterparts in the first embodiment are given the same referential codes, and are not described in detail.

In this embodiment, it is as or after the apparatus main assembly 10 has recovered from being in the state of being asleep that the control portion 71 drives the main assembly fan 12 for the duration of the preset period tp. Here, that an image forming apparatus is in the state of "being asleep" typically means that no electric power is being supplied to the fixing device 46, high voltage power source, main assembly fan 12, and various motors of the apparatus, except for the control portion 71. Generally, it means the state in which an image forming apparatus is smallest in electric power consumption, among various states in which an image forming apparatus may be on standby, until the image forming apparatus 1 receives an image formation start command.

Next, referring to the timing chart in FIG. 13, and the flowchart in FIG. 14, the steps which the image forming apparatus 1 follows to activate its main assembly fan 12 are described.

While the image forming apparatus 1 is in the state of being asleep, the control portion 71 keeps the main assembly fan 12 turned off (t10 in FIG. 13). It checks whether or not the image forming apparatus 1 is in the state of being asleep (step S21 in FIG. 14). If it determines that the image forming apparatus 1 is not asleep, it ends the process. If it determines that the image forming apparatus 1 is asleep, it stops the main assembly fan 12 (step S22 in FIG. 14).

The control portion 71 checks whether or not the image forming apparatus 1 has recovered from being asleep (step S23 in FIG. 14). If it determines that the image forming apparatus 1 has not recovered from being asleep, it keeps the main assembly fan 12 turned off (step S22 I FIG. 14). If it determines that the image forming apparatus 1 has recovered from being asleep, it begins to rotate the main assembly fan 12 at the high speed (step S24 in FIG. 14, and t11 in FIG. 13).

The control portion 71 checks whether or not the image forming apparatus 1 is on standby (step S25 in FIG. 14). If it determines that the image forming apparatus 1 is not on standby, it continues to rotate the main assembly fan 12 at the high speed (step S24 in FIG. 14). If it determines that the image forming apparatus 1 is on standby, it begins to rotate the main assembly fan 12 at the low speed (step S26 in FIG. 14, and t12 in FIG. 13).

The control portion 71 checks whether or not an image formation start command has been inputted (step S27 in FIG. 14). If it determines that an image formation start command has not been inputted, it continues to rotate the main assembly fan 12 at the low speed (step S26 in FIG. 14). If it determines that an image formation start command has been inputted, it detects temperature with the use of the ambient condition sensor 23 (step S28 in FIG. 14).

As described above, the image forming apparatus 1 in this embodiment also can more quickly ventilate itself before it puts itself on standby for image formation than an image forming apparatus structured so that the amount by which air is moved by its main assembly fan 12 before it is put on standby is not different from that after it is put on standby. Therefore, it can more quickly make the internal temperature and humidity of the apparatus main assembly 10 close to those of the ambient air. Besides, it is only for the duration of the preset period tp that the main assembly fan 12 is increased in the amount by which it moves air. Therefore, it is significantly smaller in the amount of electric power consumption than any conventionally structured image forming apparatus. That is, this embodiment also can enable an image forming apparatus to more quickly draw the ambient air into the main assembly of the apparatus while reducing the apparatus in electric power consumption and noises.

Further, according to this embodiment, it is immediately after the image forming apparatus 1 recovers from being asleep that the apparatus makes its main assembly fan 12 to rotate at the high speed. Thus, it can enable the image forming apparatus 1 to quickly draw the ambient air into the main assembly of the apparatus 1 as the apparatus 1 recovers from being asleep, while reducing the apparatus 1 in electric power consumption and noises.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-127427 filed on Jun. 25, 2015, which is hereby incorporated by reference herein in its entirety.

What is claimed is:

1. An image forming apparatus comprising:

an image forming unit configured to form an image on a sheet in accordance with inputted image data;

an opening portion configured to allow airflow between an inside and an outside of said image forming apparatus;

a detector disposed adjacent to said opening portion and configured to detect a temperature;

a fan configured to suction air through said opening and to discharge air from the inside of said image forming unit to cool said image forming unit;

a controller configured to control a rotational speed of said fan so as to rotate said fan at a first rotational speed, in an initial state of said image forming apparatus, after actuation of said image forming apparatus, and to rotate said fan at a second rotational speed, less than the first rotational speed, in a stand-by state waiting for the image data to be input after the initial state; and a setting portion configured to set an image forming condition of said image forming unit on the basis of an output of said detector acquired as a result of rotation of said fan at the first rotational speed.

2. An apparatus according to claim 1, wherein the first rotational speed is a maximum rotational speed set in said image forming apparatus.

3. An apparatus according to claim 1, wherein said image forming apparatus is started in response to a start signal produced by the actuation of said image forming apparatus.

4. An apparatus according to claim 1, wherein said detector is disposed at a position above said fan with respect to a vertical direction.

5. An apparatus according to claim 1, wherein said fan is at rest before the actuation of said image forming apparatus.

6. An apparatus according to claim 1, wherein said controller controls the image forming condition on the basis of an output of said detector for a predetermined period after a start of rotation of said fan.

7. An apparatus according to claim 1, wherein said controller controls the image forming condition on the basis of an output of said detector after the inputting of the image data.

8. An apparatus according to claim 1, wherein said detector is disposed in a space isolated from said image forming unit.

9. An apparatus according to claim 1, wherein said detector is capable of detecting humidity.

10. An apparatus according to claim 1, wherein said image forming unit forms the image on the sheet with toner, and includes a fixing unit configured to heat and to fix the toner on the sheet, wherein said detector disposed adjacent to said opening is a first detector, and said image forming apparatus further includes a second detector configured to detect a temperature of said fixing unit, and wherein said setting portion determines a target temperature of said fixing unit as the image forming condition, on the basis of the output of said first detector to control the temperature of said fixing unit so that an output of said second detector corresponds to the target temperature.

11. An apparatus according to claim 1, wherein said setting portion acquires an output of said detector in response to the input of a signal indicative of the start of the image formation based on the image data inputted in the standard-by state, and said setting portion sets the image forming condition on the basis of the output of said detector.

12. An image forming apparatus comprising:

an image forming unit for forming an image on a sheet in accordance with an input of image data;

an opening configured to allow airflow between an inside and an outside of said image forming apparatus;

a detector disposed adjacent to said opening and configured to detect a temperature;

a fan configured to suction air through said opening and to discharge air from an inside of said image forming unit to cool said image forming unit;

a controller configured to control a rotational speed of said fan so as to rotate said fan at a first rotational speed, in an initial state of said image forming apparatus, after recovering from a sleep state, and to rotate said fan at a second rotational speed, less than the first rotational speed, in a stand-by state waiting for the image data to be input, wherein electrical power consumption of said image forming apparatus in the sleep state is less than the electrical power consumption of said image forming apparatus in the stand-by state; and a setting portion configured to set an image forming condition of said image forming unit on the basis of an output of said detector acquired as a result of rotation of said fan at the first rotational speed.

13. An apparatus according to claim 12, wherein the first rotational speed is a maximum rotational speed set in said image forming apparatus.

14. An apparatus according to claim 12, wherein said detector is disposed at a position above said fan with respect to a vertical direction.

15. An apparatus according to claim 12, wherein said fan is at rest before actuation of said image forming apparatus.

16. An apparatus according to claim 12, wherein said controller controls the image forming condition on the basis of an output of said detector for a predetermined period after a start of rotation of said fan.

17. An apparatus according to claim 12, wherein said controller controls the image forming condition on the basis of an output of said detector after the input of the image data.

18. An apparatus according to claim 12, wherein said detector is disposed in a space isolated from said image forming unit.

19. An apparatus according to claim 12, wherein said detector is capable of detecting humidity.

20. An apparatus according to claim 12, wherein said setting portion acquires an output of said detector in response to the input of a signal indicative of the start of the image formation based on the image data inputted in the standard-by state, and said setting portion sets the image forming condition on the basis of the output of said detector.

21. An image forming apparatus comprising:

an image forming unit configured to form an image on a sheet in accordance with input of image data;

an opening portion configured to allow airflow between an inside and an outside of said image forming apparatus;

a detector disposed adjacent to said opening portion and configured to detect a temperature;

a fan configured to suction air through said opening and to discharge air from the inside of said image forming unit to cool said image forming unit;

a controller configured to rotate said fan at a first rotational speed for a predetermined period of time in an initial state of said image forming apparatus after actuation of a main switch of said image forming apparatus, and to rotate said fan at a second rotational speed less than the first rotational speed in a subsequent stand-by state waiting for input of the image data; and a setting portion configured to set an image forming condition of said image forming apparatus on the basis of an output of said detector, which is based on the output of said detector during rotation of said fan at the second rotational speed after the predetermined period of time.

22. An apparatus according to claim 21, wherein said image forming unit forms the image on the sheet with toner, and includes a fixing unit configured to heat and to fix the toner on the sheet, wherein said detector disposed adjacent to said opening is a first detector, and said image forming apparatus further includes a second detector configured to detect a temperature of said fixing unit, and wherein said setting portion determines a target temperature of said fixing unit as the image forming condition, on the basis of the output of said first detector to control the temperature of said fixing unit so that an output of said second detector corresponds to the target temperature.

23. An apparatus according to claim 21, wherein said setting portion acquires the output of said detector in response to input of the signal indicative of a start of image formation for image data inputted in the stand-by-state, and sets the image forming condition on the basis of the output of said detector.

24. An image forming apparatus comprising:

an image forming unit configured to form an image on a sheet in accordance with input of image data;

an opening portion configured to allow airflow between an inside and an outside of said image forming apparatus;

a detector disposed adjacent to said opening portion and configured to detect a temperature;

a fan configured to suction air through said opening and to discharge air from the inside of said image forming unit to cool said image forming unit;

a controller configured to rotate said fan at a first rotational speed for a predetermined period of time in an initial state of said image forming apparatus after recovering from a sleep state, and to rotate said fan at a second rotational speed less than the first rotational speed in a subsequent stand-by state waiting for input of the image data; and a setting portion configured to set an image forming condition of said image forming apparatus on the basis of an output of said detector during rotation of said fan at the second rotational speed after the predetermined period of time.

25. An apparatus according to claim 24, wherein said image forming unit forms the image on the sheet with toner, and includes a fixing unit configured to heat and fix the toner on the sheet, wherein said detector disposed adjacent to said opening is a first detector, and said image forming apparatus further includes a second detector configured to detect a temperature of said fixing unit, and wherein said setting portion determines a target temperature of said fixing unit as the image forming condition, on the basis of the output of said first detector to control the temperature of said fixing unit so that an output of said second detector corresponds to the target temperature.

26. An apparatus according to claim 24, wherein said setting portion acquires the output of said detector in response to input of the signal indicative of a start of image formation for image data inputted in the stand-by-state, and sets the image forming condition on the basis of the output of said detector.

* * * * *